US008276485B1

(12) United States Patent
Chen

(10) Patent No.: US 8,276,485 B1
(45) Date of Patent: Oct. 2, 2012

(54) PIVOT HEAD WRENCHING TOOL

(75) Inventor: I-Su Chen, Chang-Hwa (TW)

(73) Assignee: Infar Industrial Co., Ltd., Chang-Hwa (TW)

( * ) Notice: Subject to any disclaimer, the term of this patent is extended or adjusted under 35 U.S.C. 154(b) by 0 days.

(21) Appl. No.: 13/215,793

(22) Filed: Aug. 23, 2011

(51) Int. Cl.
*B25B 23/16* (2006.01)

(52) U.S. Cl. ..... 81/177.8; 81/177.85; 81/63.2; 81/135; 81/177.9

(58) Field of Classification Search ..... 81/177.7–177.9, 81/60, 300, 427, 329, 3.6, 486, 63.2, 63, 81/62, 58.4; 7/125–137, 900; 403/93
See application file for complete search history.

(56) References Cited

U.S. PATENT DOCUMENTS 5,533,427 A * 7/1996 Chow ..... 81/63.2
6,732,614 B2 * 5/2004 Hu ..... 81/63.2
6,799,493 B2 * 10/2004 Wang ..... 81/135
7,318,366 B2 * 1/2008 Lee et al. ..... 81/177.9
7,509,893 B2 * 3/2009 Wu ..... 81/177.8
2011/0167967 A1 * 7/2011 Chen ..... 81/177.8
* cited by examiner

*Primary Examiner* — Monica Carter
*Assistant Examiner* — Melanie Alexander
(74) *Attorney, Agent, or Firm* — Muncy, Geissler, Olds & Lowe, PLLC

(57) ABSTRACT

A pivot head wrenching tool includes a handle, a switch, a pawl, a torsion spring, and a pivotal driving head. The pivot head wrenching tool is operable in a lock mode in which the pivotal driving head is restrained from being pivoted and in an unlock mode in which the pivotal driving head is able to be pivoted. The switch is in a first position and includes a first surface abutted against the pawl as well as the pawl is engaged with a connecting end of the pivotal driving head when the pivot head wrenching tool is in the lock mode. The switch is in a second position and includes a second surface gapped from the pawl as well as the pawl is disengaged from the connecting end of the pivotal driving head when the pivot head wrenching tool is in the unlock mode.

19 Claims, 11 Drawing Sheets

PIVOT HEAD WRENCHING TOOL

BACKGROUND OF THE INVENTION

1. Field of the Invention

The present invention relates to a pivot head wrenching tool and, in particular, to a pivot head wrenching tool operable in a lock mode in which the pivot head wrenching tool includes a pivotal driving head restrained from being pivoted and in an unlock mode in which the pivot driving head can be operably pivoted.

2. Description of the Related Art

U.S. Pat. No. 7,509,893 shows a locking device for locking a pivotal head of a hand tool. A switch member includes a shank rotatably inserted in a recess defined in the pivotal head of the hand tool. The shank includes a convex and curved surface and a flat surface. A pawl and a spring are received in a passage. The pawl includes a plurality of teeth defined on a first end thereof. When the pawl is pushed to engage with the pivotal head, the teeth of the pawl engages with a plurality of engaging teeth defined on the pivotal head, and the convex and curved surface of the shank engages a second end of the pawl. Additionally, when the shank is rotated to a position such that the flat surface thereof contacts the second end of the pawl, the teeth of the pawl are disengaged from the engaging teeth of the pivotal head, thereby enabling the pivotal head to be operably pivoted. The problem that the hand tool suffers is that it requires a retaining means to prevent the spring from disengagement from the pawl. In addition, the elastic spring suffers a fatigue problem such that the spring can not push the pawl to an extent that enables the pivotal head to be retained in a desired position precisely.

The present invention is, therefore, intended to obviate or at least alleviate the problems encountered in the prior art.

SUMMARY OF THE INVENTION

According to the present invention, a pivot head wrenching tool includes a handle, a switch, a pawl, a torsion spring, and a pivotal driving head. The handle includes a receiving space, a bore, and a channel. The receiving space is disposed separately from the bore, and the channel interconnects the receiving space and the bore. The switch is rotatably engaged in the bore and includes a first circumferential edge extending in a first plane and including first and second surfaces. The switch operable in a first position including the first surface facing the channel and in a second position including the second surface facing the channel. The pawl is disposed in the channel. The torsion spring is engaged with the switch. The torsion spring includes a length encircling the switch. Also, the torsion spring includes first and second ends restrained in the switch and the handle respectively. The torsion spring is tensioned upon rotating the switch in a first direction. On the contrary, the torsion spring untensoined upon rotating the switch in a second direction reverse to the first direction. The pivotal driving head is pivotally movable at various pivotal positions with respect to and engaged with the handle. The pivotal driving head includes a connecting end and a driving end. The connecting end and the handle include a pivot interconnecting therewith for connection between the pivotal driving head and the handle. The connecting end is received in the receiving space. The driving end is used for engaging with an object to be driven by the pivot head wrenching tool. The pivotal driving head includes the connecting end releasably engaging with the pawl.

Furthermore, the pivot head wrenching tool is operable in a lock mode in which the pivotal driving head is restrained from being pivoted and in an unlock mode in which the pivotal driving head is able to be pivoted. The switch is in the first position and includes the first surface abutted against the pawl as well as the pawl is engaged with the connecting end of the pivotal driving head when the pivot head wrenching tool is in the lock mode. The switch is in the second position and includes the second surface gapped from the pawl as well as the pawl is disengaged from the connecting end of the pivotal driving head when the pivot head wrenching tool is in the unlock mode. The pawl moves towards the switch to disengage from the connecting end of the pivotal driving head upon pivoting the pivotal driving head. The switch automatically moves from the second position to the first position under resilient force of the torsion spring.

It is an object of the present invention to provide a pivot head wrenching tool that has a simple configuration than a conventional pivot head wrenching tool.

It is another object of the present invention to provide a pivot head wrenching tool that includes a simple mechanism for selectively retaining a pivotal driving head of the pivot head wrenching tool in a selected one of a plurality of pivotal positions.

Other objects, advantages, and new features of the present invention will become apparent from the following detailed description of the invention when considered in conjunction with the accompanied drawings.

DETAILED DESCRIPTION OF THE PREFERRED EMBODIMENT

Figure 1:
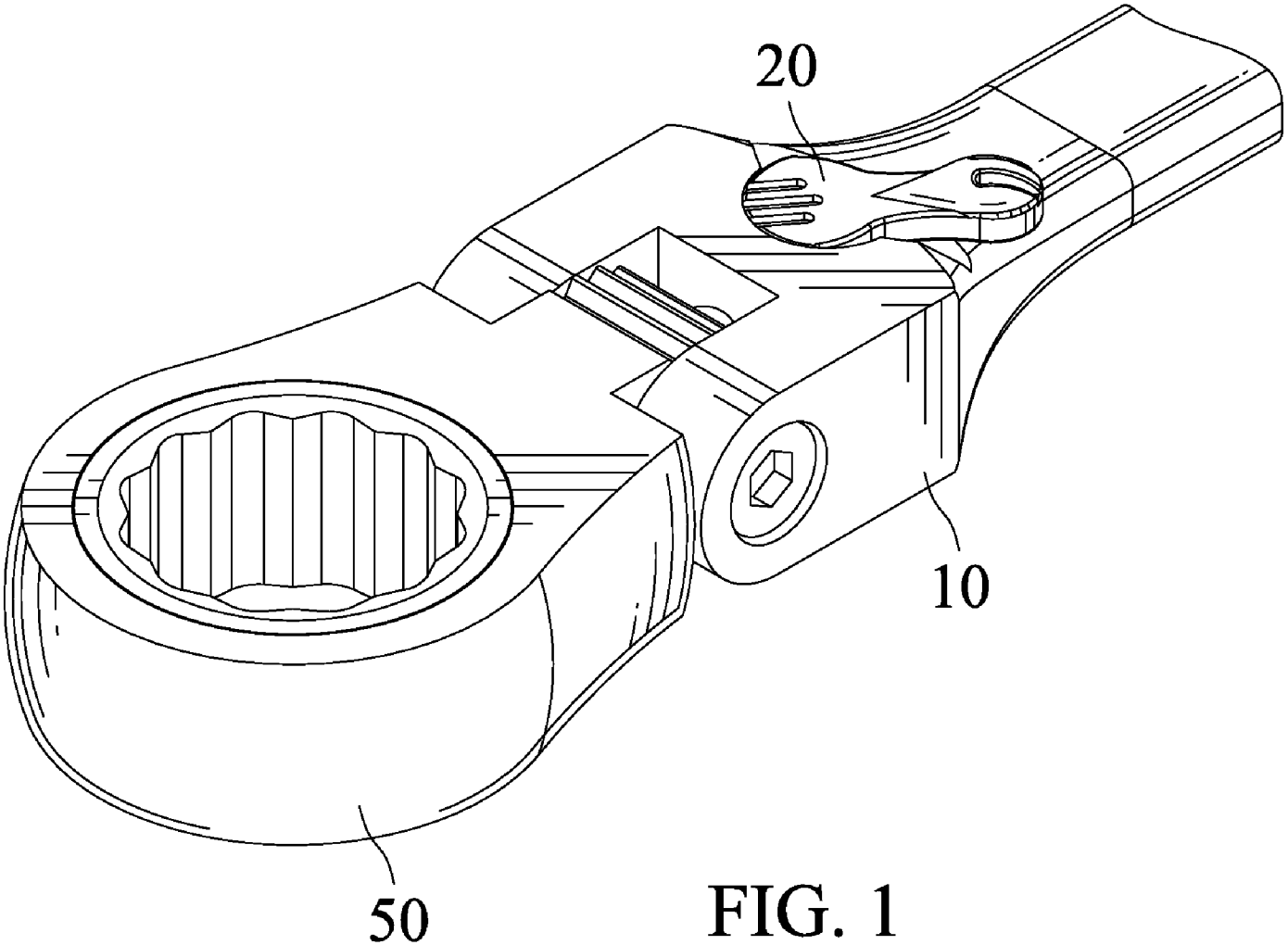
FIG. 1 is a perspective view of a pivot head wrenching tool in accordance with the present invention and shows it in a lock mode in which a pivotal driving head is restrained from being pivoted.
Figure 2:
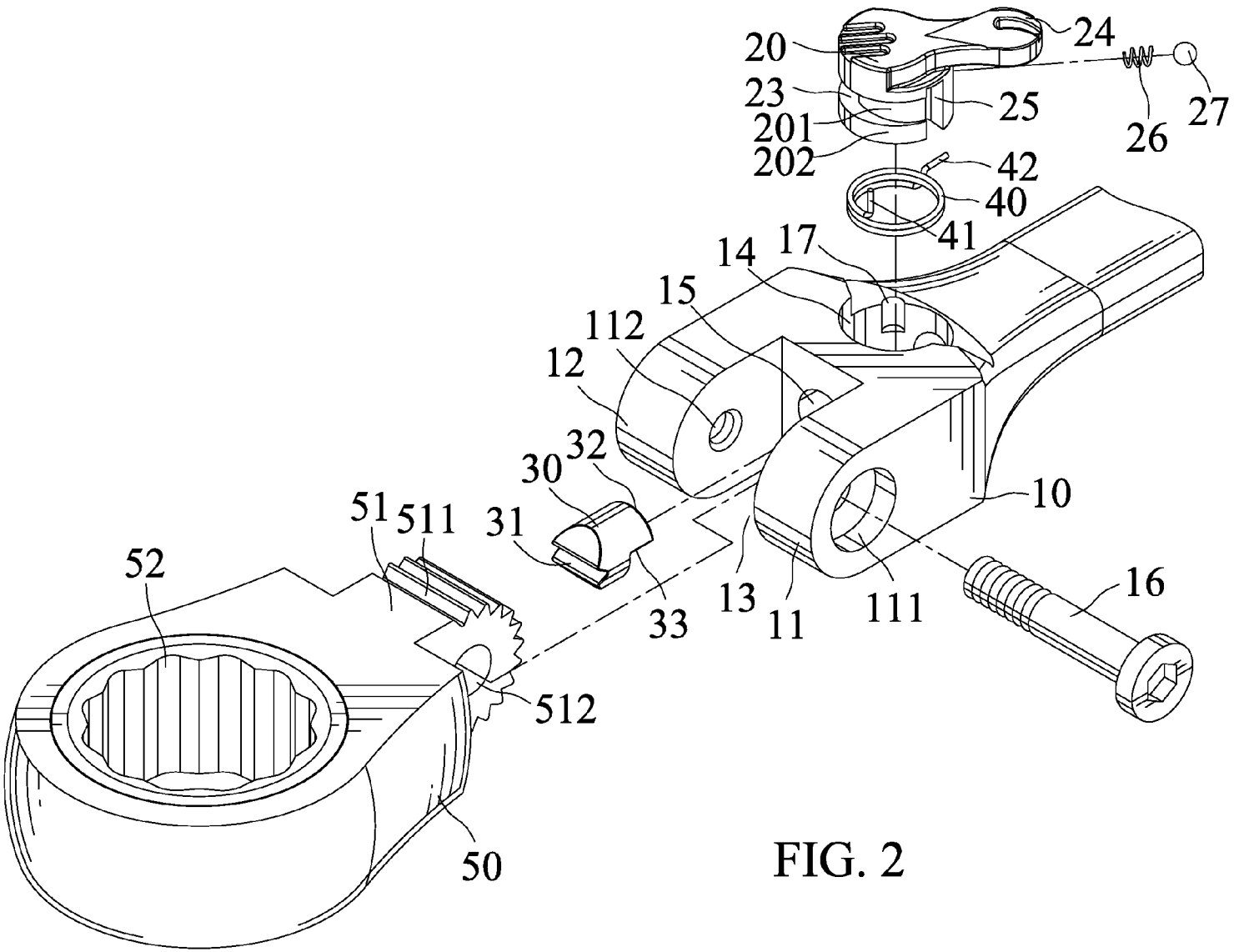
FIG. 2 is an exploded perspective view of the pivot head wrenching tool of FIG. 1.
Figure 3:
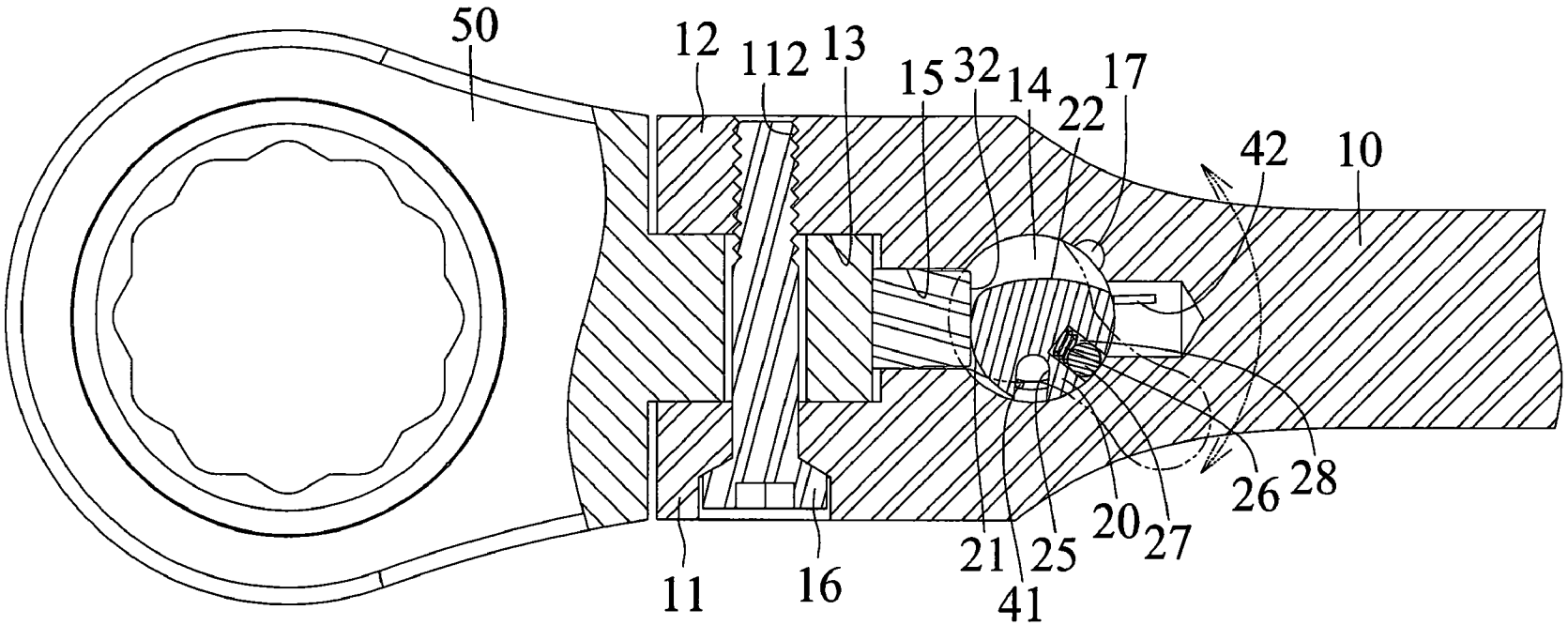
FIG. 3 is a cross-sectional view of the pivot head wrenching tool of FIG. 1 and shows it in the lock mode.
Figure 4:
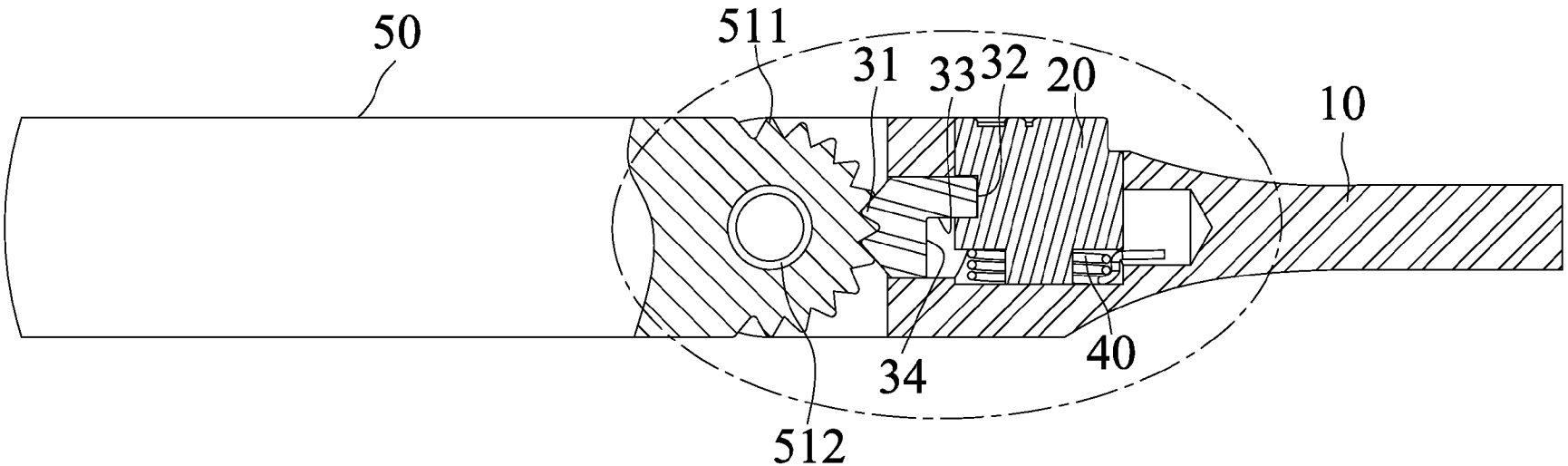
FIG. 4 is another cross-sectional view of the pivot head wrenching tool of FIG. 1 and shows it in the lock mode.
Figure 5:
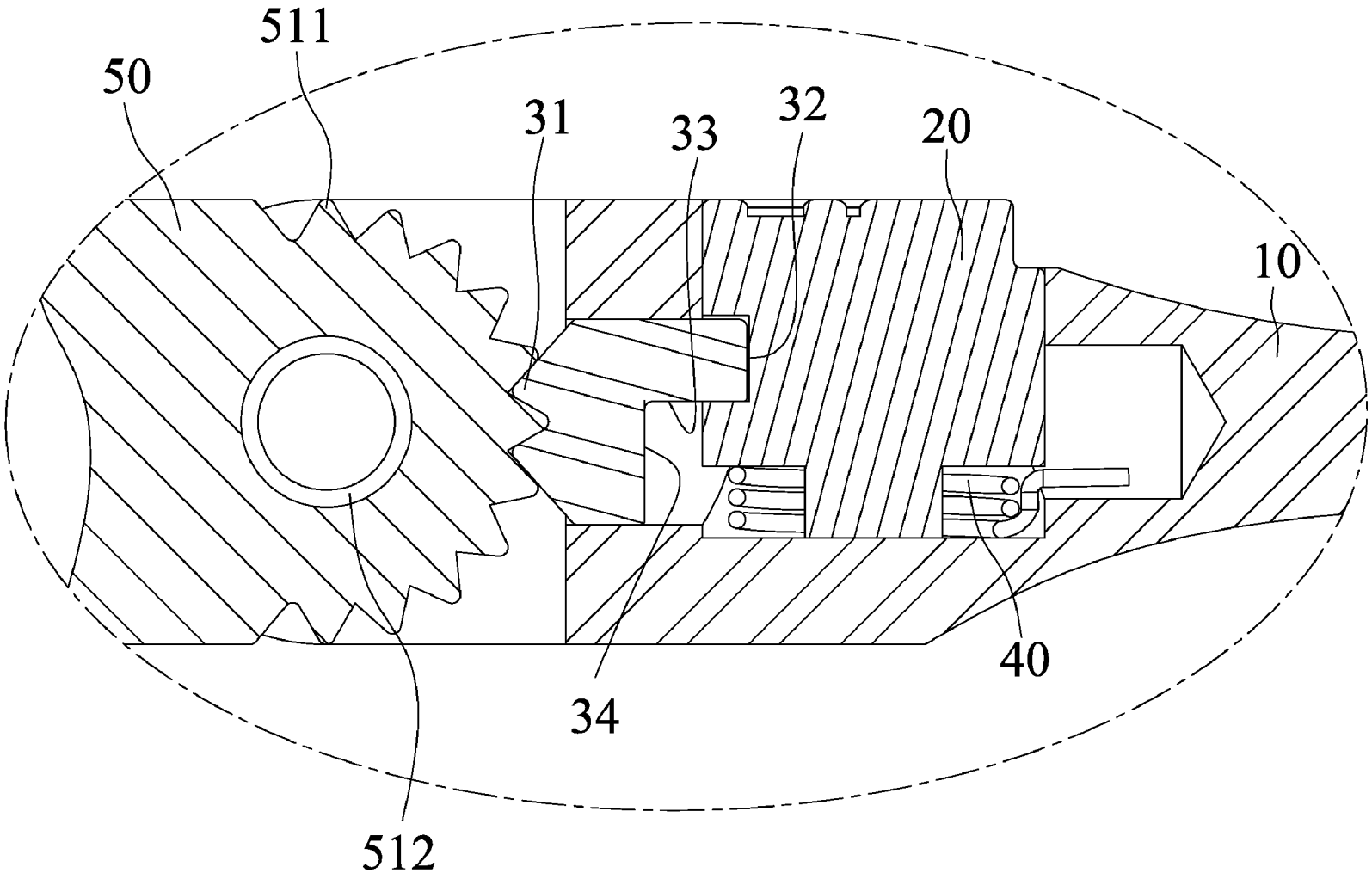
FIG. 5 is a partial, enlarged cross-sectional view of FIG. 4.
Figure 6:
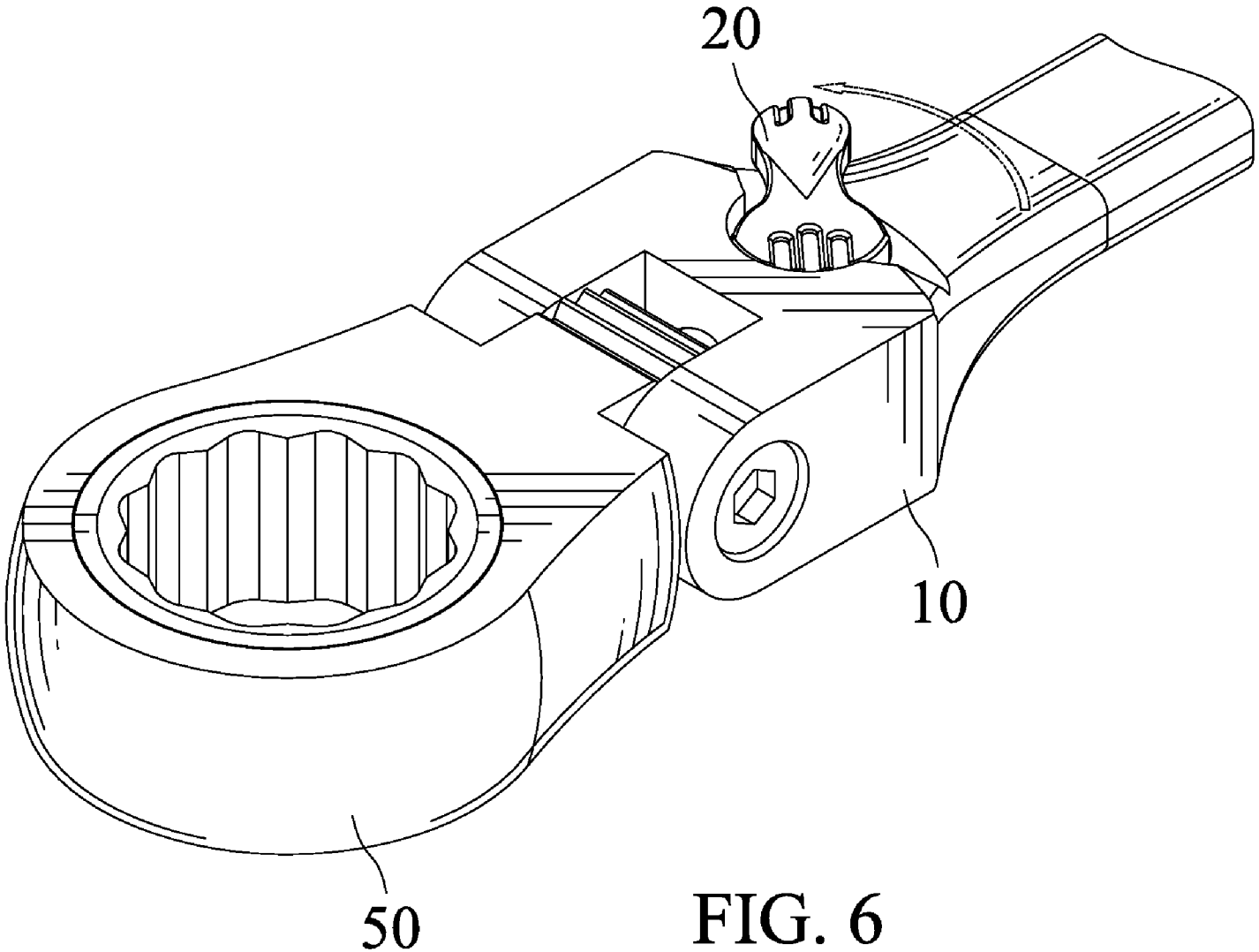
FIG. 6 is a perspective view of a pivot head wrenching tool of FIG. 1 and shows it in an unlock mode in which the pivotal head can be operably pivoted.
Figure 7:
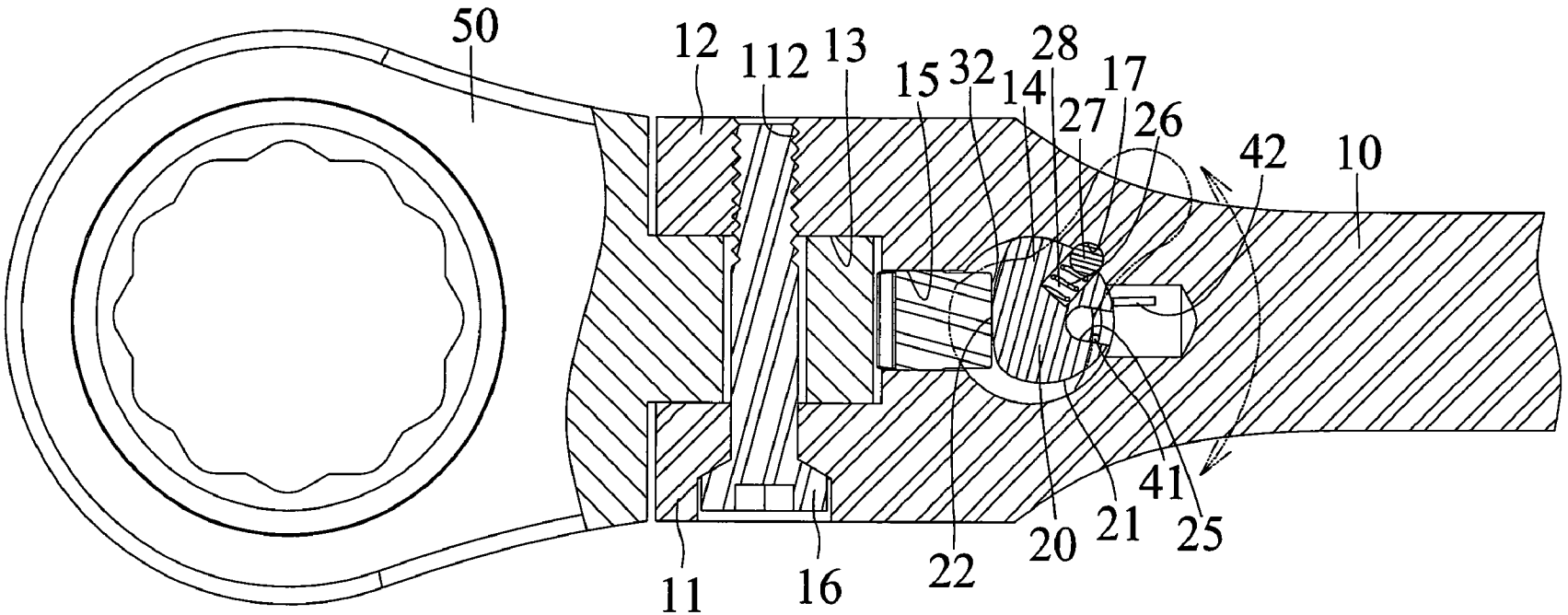
FIG. 7 is a cross-sectional view of the pivot head wrenching tool of FIG. 1 in the unlock mode.
Figure 8:
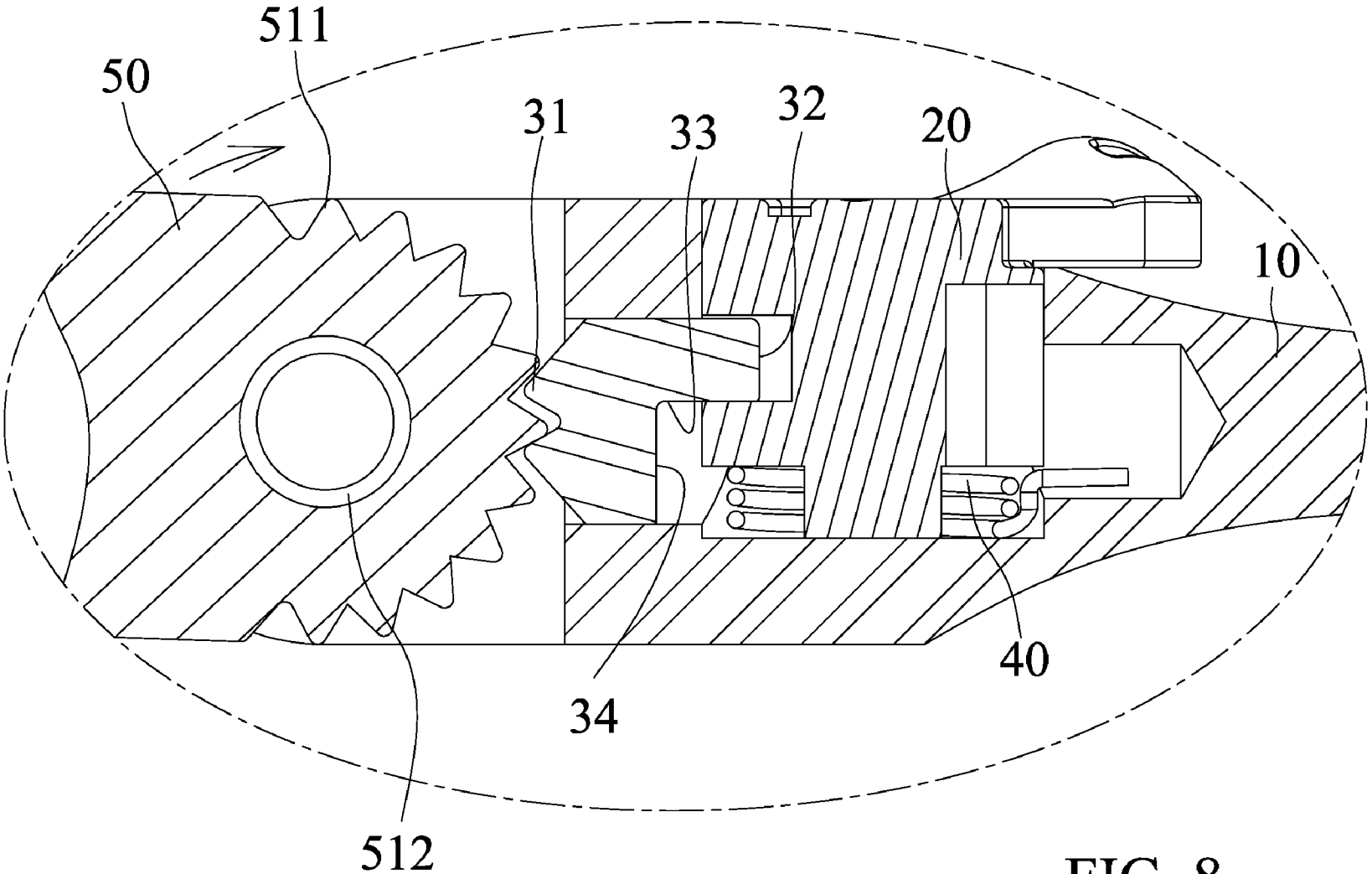
FIG. 8 is an extended cross-sectional view of FIG. 7 and shows the pivotal driving head detached from a pawl at a first distance and adapted to be pivoted.
Figure 9:
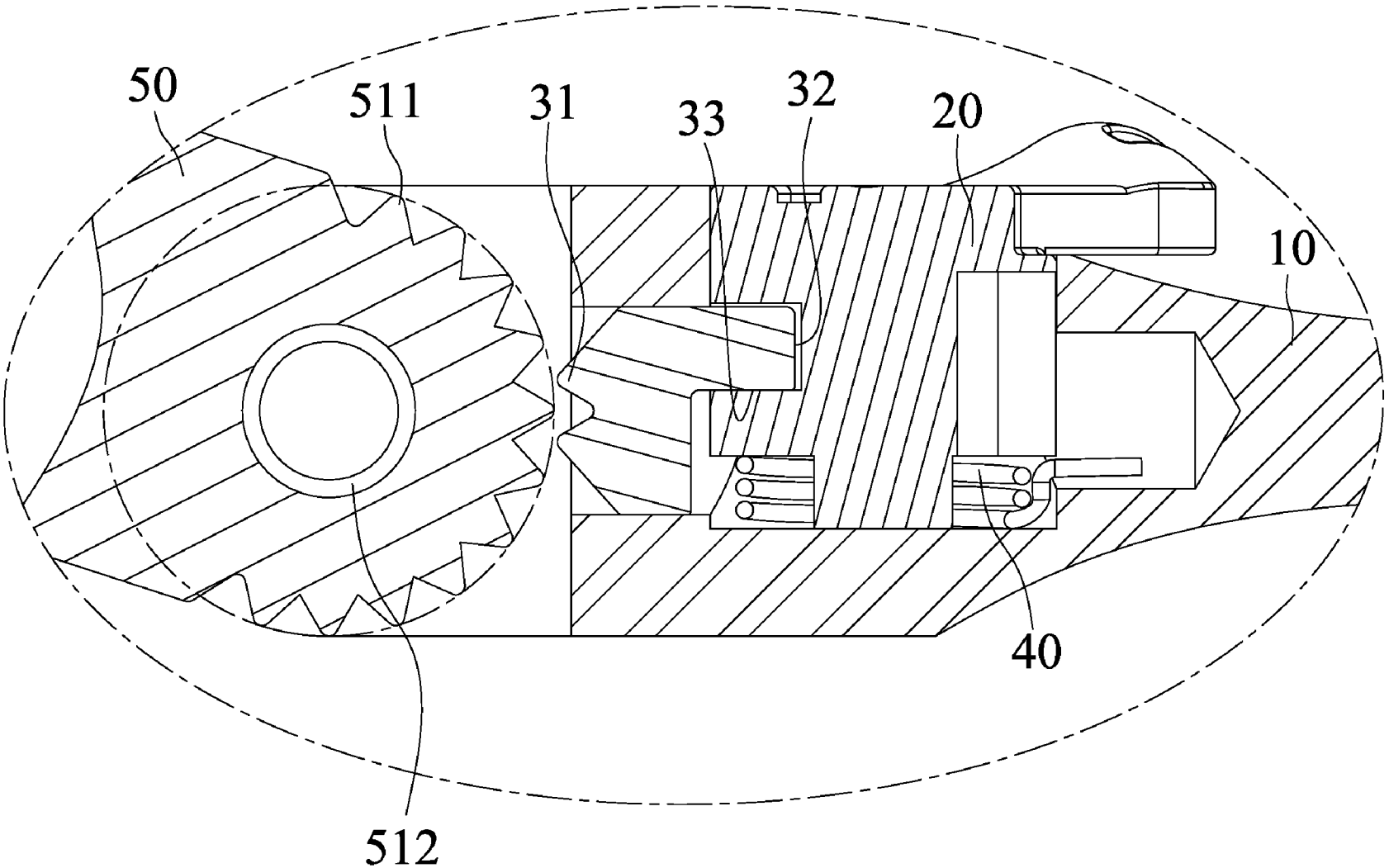
FIG. 9 is an extended cross-sectional view of FIG. 8 and shows the pivotal driving head and the pawl detached at a second distance and is free of interaction with the pawl.
Figure 10:
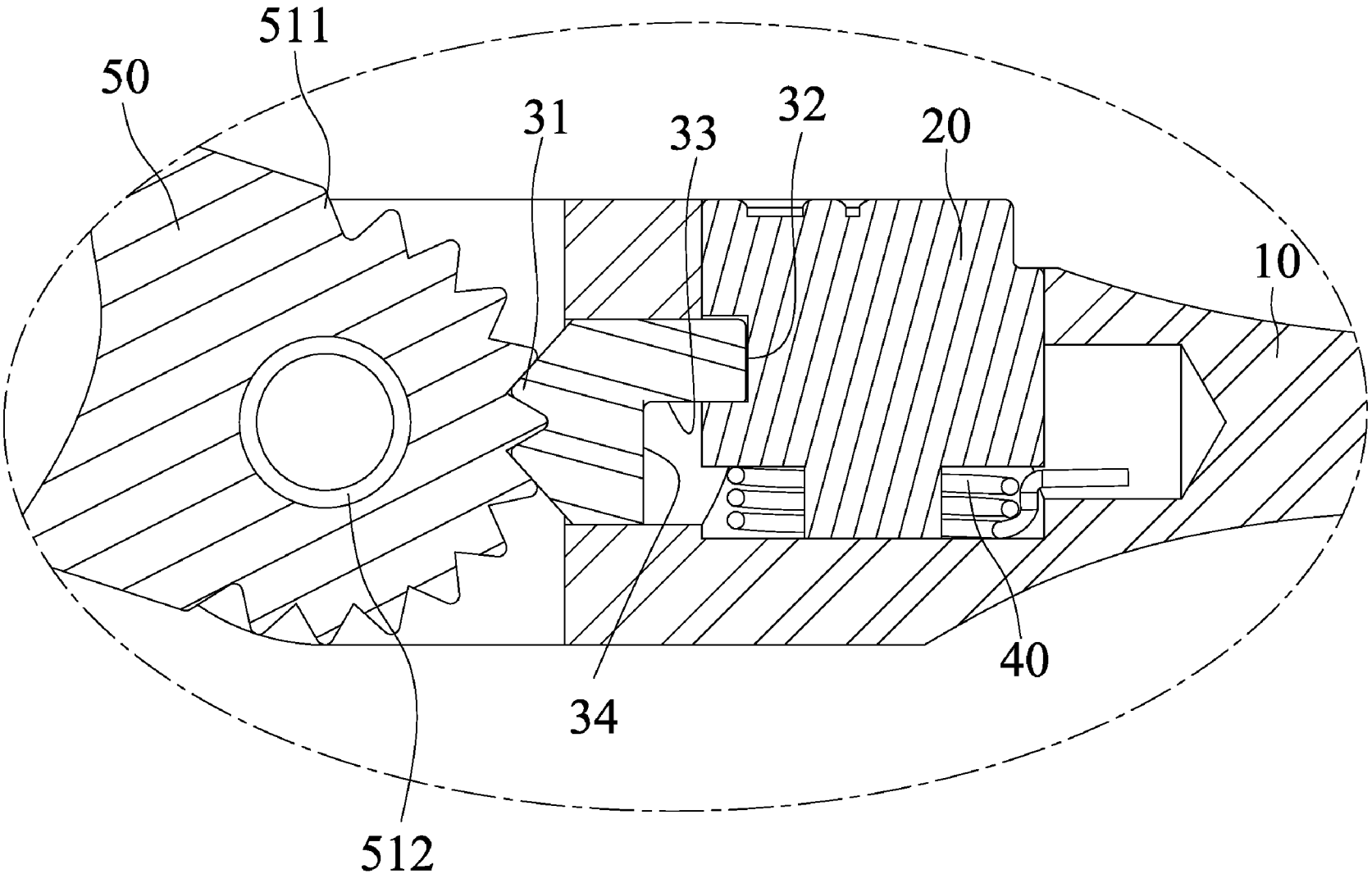
FIG. 10 is an extended cross-sectional view of FIG. 9 and shows the pivot head wrenching tool in the lock mode and the pivotal driving head in a pivotal position different from FIG. 1.
Figure 11:
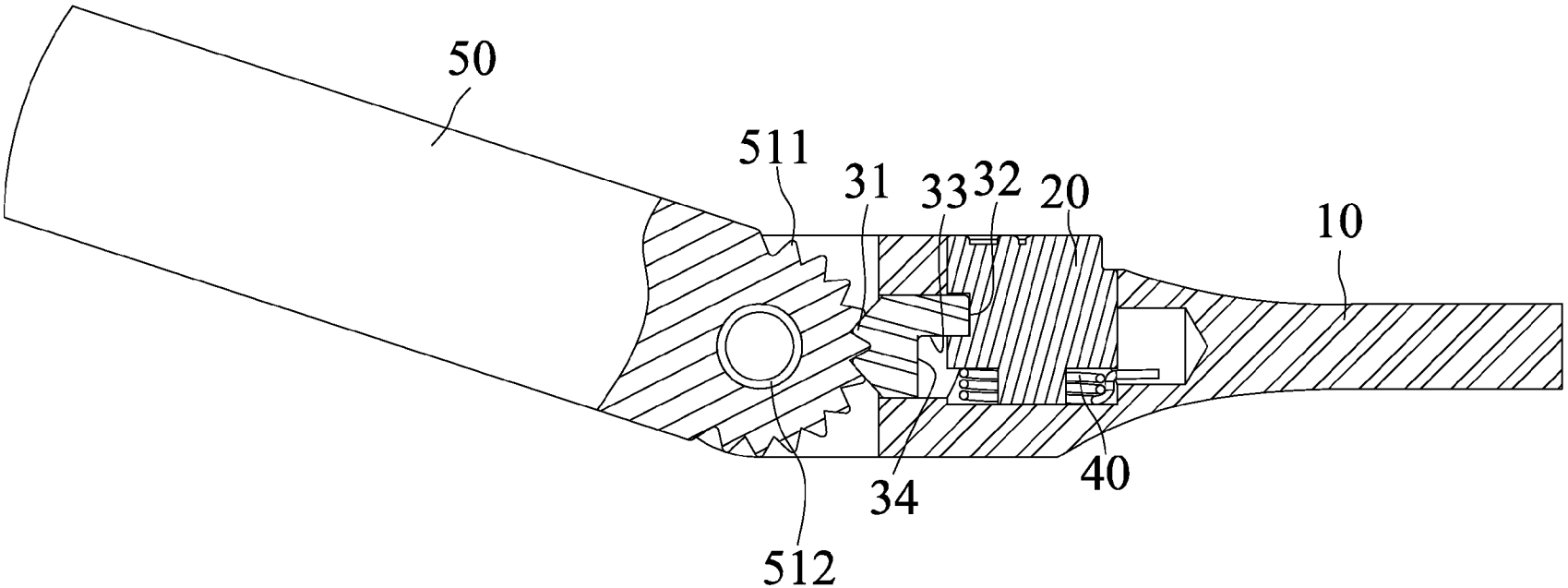
FIG. 11 is a cross-sectional view of the pivot head wrenching tool and shows the pivotal driving head in the pivotal position shown in FIG. 10.

Referring to FIGS. 1 through 11, a pivot head wrenching tool in accordance with the present invention includes a handle 10, a switch 20, a pawl 30, a torsion spring 40, and a pivotal driving head 50.

The handle 10 serves as a lever arm and is grasped by an operator during the operation of the pivot head wrenching tool. The handle 10 includes a receiving space 13, a bore 14, a channel 15, and a recess 17. The receiving space 13 is disposed separately from the bore 14. The channel 15 interconnects the receiving space 13 and the bore 14. The recess 17 is defined in a peripheral wall of the bore 14. Moreover, the handle 10 includes two opposite sides and the bore 14 extending from the one of the two sides and terminating before the other of the two sides such that the bore 14 includes an opening at one of two distal ends and the other distal end enclosed by a wall of the handle 10. The handle 10 further includes first and second prongs 11 and 12 disposed oppositely and the receiving space 13 disposed between the first and second prongs 11 and 12. The first and second prongs 11 and 12 extend longitudinally in the same direction. The first prong 11 includes a first hole 111 extending therein. The second prong 12 includes a second hole 112 extending therein.

The switch 20 is rotatably engaged in the bore 14. The switch 20 includes a first circumferential edge 201 extending in a first plane and including first and second surfaces 21 and 22. The switch 20 further includes a second circumferential edge 202 extending in a second plane, which is parallel to the first plane. The first circumferential edge 201 has a first cross-sectional size. The second circumferential edge 202 has a second cross-sectional size, which is greater than the first cross-sectional size. Further, a ledge 23 extends radially from the first circumferential edge 201 to the second circumferential edge 202 and parallel to the first and second planes. The switch 20 is operable in a first position including the first surface 21 facing the channel 15 and in a second position including the second surface 22 facing the channel 15. Moreover, the switch 20 includes an operation end 25 disposed outside the bore 14 so as to allow a user to easy operably rotate the switch 20.

The pawl 30 is disposed in the channel 15. The pawl 30 includes first, second and third engaging edges 32, 33 and 34. The first edge 32 is faces the first circumferential edge 201. The second edge 33 is movably engaged on the ledge 23. The third edge 34 faces the second circumferential edge 202. Furthermore, the first, second and third engaging edges 32, 33 and 34 form a step shape.

The torsion spring 40 is engaged with the switch 20 and includes a length encircling the switch 20 and first and second ends 41 and 42 restrained in the switch 20 and the handle 10 respectively. The first and second ends 41 and 42 of the torsion spring 40 extend in different directions. The first end 41 of the torsion spring 40 extends upwardly along the switch 20. The second end 42 of the torsion spring 40 extends horizontally and away from the switch 20. In the embodiment, the torsion spring 40 includes at least one loop encircling the switch 20. The switch 20 includes a slot 25 extended therein receiving the first end 41 of the torsion spring 40. The torsion spring 40 is tensioned upon rotating the switch 20 in a first direction. Likewise, the torsion spring 40 is untensoined upon rotating the switch 20 in a second direction reverse to the first direction.

The pivotal driving head 50 is pivotally movable at various pivotal positions with respect to and engaged with the handle 10. The pivotal driving head 50 includes a connecting end 51 and a driving end 52. The connecting end 51 and the handle 10 including a pivot 16 interconnecting therewith for connection between the pivotal driving head 50 and the handle 10. The connecting end 51 is received in the receiving space 13. The connecting end 51 is releasably engaged with the pawl 30. The driving end 52 is used for engaging with an object to be driven by the pivot head wrenching tool. Further, a third hole 512 extends in the pivotal driving head 50. Additionally, the pivot 16 is engaged in the first, second and third holes 111, 112 and 113.

Further, a positioning mechanism includes a resilient member 26 and a detent 27. The detent 27 is biased by the resilient member 26. Additionally, the switch 20 includes a receptacle 28 defined therein. The receptacle 28 includes the resilient member 26 and the detent 27 received therein. The detent 27 is selectively engagable in the recess 17.

The pivot head wrenching tool is operable in a lock mode in which the pivotal driving head 50 is restrained from being pivoted and in an unlock mode in which the pivotal driving head 50 is able to be pivoted. The switch 20 is in the first position and includes the first surface 21 abutted against the first engaged edge 32 of the pawl 30 as well as the pawl 30 is engaged with the connecting end 51 of the pivotal driving head 50 when the pivot head wrenching tool is in the lock mode. In the embodiment, the pawl 30 includes a first plurality of teeth 31 and the connecting end 51 of the pivotal driving head 50 includes a second plurality of teeth 511, and each of the first plurality of teeth 31 is engaged with and disposed between two adjacent teeth of the second plurality of teeth 512 when the pivot head wrenching tool is in the lock mode. Additionally, each of the first plurality of teeth 31 includes a shape including two first oblique surfaces disposed opposite to each other and including an apex edge where the two first oblique surfaces intersect, and the apex of one of the first plurality of teeth 31 extends parallel to the other of the first plurality of teeth 31. Likewise, each of the second plurality of teeth 511 includes a shape including two second oblique surfaces disposed opposite to each other and including an apex edge where the two second oblique surfaces intersect, and the apex of one of the second plurality of teeth 511 extending parallel to the other of the second plurality of teeth 511. The switch 20 is in the second position and includes the second surface 22 gapped from the pawl 30 as well as the pawl 30 is disengaged from the connecting end 51 of the pivotal driving head 50 when the pivot head wrenching tool is in the unlock mode. The pawl 30 moves towards the switch 20 to disengage from the connecting end 51 of the pivotal driving head 50 upon pivoting the pivotal driving head 50. The switch 50 automatically moves from the second position to the first position under resilient force of the torsion spring 40.

Additionally, the switch 20 is adapted to be retained in the second position with the positioning mechanism, with the positioning mechanism counteracting the resilient force of the torsion spring 40 to prevent the switch 20 from automatically moving from the second position to the first position. Moreover, the detent 27 is not engaged in the recess 17 when the switch 20 is in the first position, and the detent 27 is engaged in the recess 17 when the switch is in the second position.

In view of the forgoing, the pivotal driving head 50 is therefore adapted to be precisely restrained at a selected pivotal position when the pivot head wrenching tool is in the lock mode. The advantages of the pivot head wrenching tool is that it is has a simple configuration, and the parts can be easily installed in the handle 10, and the mechanism for selectively retaining a pivotal driving head 50 in a selected one of a plurality of pivotal positions is simple.

While the specific embodiment has been illustrated and described, numerous modifications come to mind without significantly departing from the spirit of invention and the scope of invention is only limited by the scope of accompanying claims.

What is claimed is:

1. A pivot head wrenching tool comprising:

a handle including a receiving space, a bore, and a channel, with the receiving space disposed separately from the bore, with the channel interconnecting the receiving space and the bore;

a switch rotatably engaged in the bore and including a first circumferential edge extending in a first plane and including first and second surfaces, with the switch operable in a first position including the first surface facing the channel and in a second position including the second surface facing the channel;

a pawl disposed in the channel;

a torsion spring engaged with the switch, with the torsion spring including a length encircling the switch, with the torsion spring including first and second ends restrained in the switch and the handle respectively, with the first and second ends of the torsion spring extending in two different directions, with the switch including a slot extended therein receiving the first end of the torsion spring, with the first end of the torsion spring extending upwardly along the switch, with the second end of the torsion spring extending horizontally and away from the switch and oppositely to the pawl, with the torsion spring tensioned upon rotating the switch in a first direction, with the torsion spring untensoined upon rotating the switch in a second direction reverse to the first direction; and a pivotal driving head pivotally movable at various pivotal positions with respect to and engaged with the handle, with the pivotal driving head including a connecting end and a driving end, with the connecting end and the handle including a pivot interconnecting therewith for connection between the pivotal driving head and the handle, with the connecting end received in the receiving space, with the driving end used for engaging with an object to be driven by the pivot head wrenching tool, with the pivotal driving head including the connecting end releasably engaged with the pawl;

wherein the pivot head wrenching tool is operable in a lock mode in which the pivotal driving head is restrained from being pivoted and in an unlock mode in which the pivotal driving head is able to be pivoted, with the switch in the first position and including the first surface abutted against the pawl as well as the pawl engaged with the connecting end of the pivotal driving head when the pivot head wrenching tool is in the lock mode, with the switch in the second position and including the second surface gapped from the pawl as well as the pawl disengaged from the connecting end of the pivotal driving head when the pivot head wrenching tool is in the unlock mode, with the pawl moving towards the switch to disengage from the connecting end of the pivotal driving head upon pivoting the pivotal driving head, with the switch automatically moving from the second position to the first position under resilient force of the torsion spring.

2. The pivot head wrenching tool as claimed in claim 1, wherein the pawl includes a first plurality of teeth, wherein the connecting end of the pivotal driving head includes a second plurality of teeth, with each of the first plurality of teeth engaged with and disposed between two adjacent teeth of the second plurality of teeth when the pivot head wrenching tool is in the lock mode.

3. The pivot head wrenching tool as claimed in claim 2 wherein each of the first plurality of teeth includes a shape including two first oblique surfaces disposed opposite to each other and including an apex edge where the two first oblique surfaces intersect, with the apex of one of the first plurality of teeth extending parallel to the other of the first plurality of teeth, wherein each of the second plurality of teeth includes a shape including two second oblique surfaces disposed opposite to each other and including an apex edge where the two second oblique surfaces intersect, with the apex of one of the second plurality of teeth extending parallel to the other of the second plurality of teeth.

4. The pivot head wrenching tool as claimed in claim 1, wherein the switch includes a second circumferential edge extending in a second plane, with the second plane parallel to the first plane, with the first circumferential edge having a first cross-sectional size, with the second circumferential edge having a second cross-sectional size, with the second cross-sectional size greater than the first cross-sectional size.

5. The pivot head wrenching tool as claimed in claim 4, wherein the switch includes a ledge extending radially from the first circumferential edge to the second circumferential edge and parallel to the first and second planes.

6. The pivot head wrenching tool as claimed in claim 5, wherein the pawl includes first, second and third engaging edges, with the first edge to facing the first circumferential edge, with the second edge movably engaged on the ledge, with the third edge facing the second circumferential edge.

7. The pivot head wrenching tool as claimed in claim 6, wherein the first engaged edge is abutted against the first surface of the switch when the pivot head wrenching tool is in the lock mode.

8. The pivot head wrenching tool as claimed in claim 6, wherein the first, second and third engaging edges form a step shape.

9. The pivot head wrenching tool as claimed in claim 1, wherein the handle includes first and second prongs disposed oppositely and the receiving space disposed between the first and second prongs.

10. The pivot head wrenching tool as claimed in claim 9, wherein the first prong includes a first hole extending therein the second prong includes a second hole extending therein the connecting end of the pivotal driving head includes a third hole extending therein respectively, with the pivot engaged in the first, second and third holes.

11. The pivot head wrenching tool as claimed in claim 1, wherein the handle includes two opposite sides, with the bore extending from the one of the two sides and terminating before the other of the two sides such that the bore includes an opening at one of two distal ends and the other distal end enclosed by a wall of the handle.

12. The pivot head wrenching tool as claimed in claim 1, wherein the torsion spring includes at least one loop encircling the switch.

13. The pivot head wrenching tool as claimed in claim 1, wherein the switch includes an operation end extending outside the bore so as to allow a user to operably rotate the switch easily.

14. The pivot head wrenching tool as claimed in claim 1 further comprising a positioning mechanism, with the positioning mechanism including a resilient member and a detent, with the detent biased by the resilient member, with the switch including a receptacle defined therein, with the receptacle receiving the resilient member and the detent, wherein the handle includes a recess defined in a peripheral wall of the bore, and wherein the detent is selectively engaged in the recess, with the detent not engaged in the recess when the switch is in the first position, with the detent engaged in the recess when the switch is in the second position.

15. The pivot head wrenching tool as claimed in claim 14, wherein the pawl includes a first plurality of teeth, wherein the connecting end of the pivotal driving head includes a second plurality of teeth, with each of the first plurality of teeth engaged with and disposed between two adjacent teeth of the second plurality of teeth when the pivot head wrenching tool is in the lock mode.

16. The pivot head wrenching tool as claimed in claim 14, wherein each of the first plurality of teeth includes a shape including two first oblique surfaces disposed opposite to each other and including an apex edge where the two first oblique surfaces intersect, with the apex of one of the first plurality of teeth extending parallel to the other of the first plurality of teeth, wherein each of the second plurality of teeth includes a shape including two second oblique surfaces disposed opposite to each other and including an apex edge where the two second oblique surfaces intersect, with the apex of one of the second plurality of teeth extending parallel to the other of the second plurality of teeth.

17. The pivot head wrenching tool as claimed in claim 14, wherein the switch includes a second circumferential edge extending in a second plane, with the second plane parallel to the first plane, with the first circumferential edge having a first cross-sectional size, with the second circumferential edge having a second cross-sectional size, with the second cross-sectional size greater than the first cross-sectional size.

18. The pivot head wrenching tool as claimed in claim 17, wherein the switch includes a ledge extending radially from the first circumferential edge to the second circumferential edge and parallel to the first and second planes.

19. The pivot head wrenching tool as claimed in claim 18, wherein the pawl includes first, second and third engaging edges, with the first edge facing the first circumferential edge, with the second edge movably engaged on the ledge, with the third edge facing the second circumferential edge.

* * * * *